US011885096B2

(12) United States Patent
Seki et al.

(10) Patent No.: US 11,885,096 B2
(45) Date of Patent: Jan. 30, 2024

(54) LOADING MACHINE CONTROL DEVICE AND LOADING MACHINE CONTROL METHOD

(71) Applicant: Komatsu Ltd., Tokyo (JP)

(72) Inventors: Yohei Seki, Tokyo (JP); Masataka Ozaki, Tokyo (JP)

(73) Assignee: Komatsu Ltd., Tokyo (JP)

( * ) Notice: Subject to any disclaimer, the term of this patent is extended or adjusted under 35 U.S.C. 154(b) by 676 days.

(21) Appl. No.: 17/043,002

(22) PCT Filed: Mar. 11, 2019

(86) PCT No.: PCT/JP2019/009791

§ 371 (c)(1),
(2) Date: Sep. 29, 2020

(87) PCT Pub. No.: WO2019/207982

PCT Pub. Date: Oct. 31, 2019

(65) Prior Publication Data

US 2021/0010225 A1 Jan. 14, 2021

(30) Foreign Application Priority Data

Apr. 27, 2018 (JP) ..... 2018-087775

(51) Int. Cl.

| | |
|---|---|
| ***E02F 3/43*** | (2006.01) |
| ***E02F 9/20*** | (2006.01) |
| ***E02F 9/26*** | (2006.01) |

(52) U.S. Cl.

CPC ..... *E02F 3/431* (2013.01); *E02F 9/2033* (2013.01); *E02F 9/265* (2013.01)

(58) Field of Classification Search

CPC ..... E02F 3/431; E02F 3/434; E02F 9/2033; E02F 9/262; E02F 9/265

See application file for complete search history.

(56) References Cited

U.S. PATENT DOCUMENTS

| | | | |
|---|---|---|---|
| 6,247,538 | B1 | 6/2001 | Takeda et al. |
| 6,363,632 | B1 | 4/2002 | Stentz et al. |

(Continued)

FOREIGN PATENT DOCUMENTS

| | | | |
|---|---|---|---|
| AU | 199897027 | A1 | 7/1999 |
| CN | 107532410 | A | 1/2018 |

(Continued)

OTHER PUBLICATIONS

Extended European Search Report dated Oct. 13, 2021, issued in the corresponding European patent application No. 19792698.3.

(Continued)

*Primary Examiner* — Tyler J Lee
(74) *Attorney, Agent, or Firm* — Locke Lord LLP

(57) ABSTRACT

A loading machine control device includes a measurement data acquisition unit acquiring measurement data of a measurement device mounted in a loading machine having working equipment, a target calculation unit calculating, based on the measurement data, a position of an upper end portion of a loading target to which an excavation object excavated by a bucket of the working equipment is loaded, a bucket calculation unit calculating position data of the bucket, an overlap determination unit determining whether the upper end portion of the loading target and the bucket that are in the measurement data overlap each other, and a working equipment control unit controlling the working equipment based on the measured position of the upper end portion of the loading target when it is determined that the upper end portion of the loading target and the bucket that are in the measurement data do not overlap each other.

7 Claims, 12 Drawing Sheets

(56) References Cited

U.S. PATENT DOCUMENTS

| | | | | |
|---|---|---|---|---|
| 6,539,294 | B1 * | 3/2003 | Kageyama | E02F 9/2045 701/25 |
| 6,931,772 | B2 * | 8/2005 | Furuno | E02F 9/264 701/50 |
| 8,583,361 | B2 * | 11/2013 | Lewis | G05D 1/0061 701/418 |
| 8,862,390 | B2 * | 10/2014 | Sugawara | G08G 1/137 701/431 |
| 9,823,082 | B2 * | 11/2017 | Lewis | G08G 1/096775 |
| 9,988,007 | B2 | 6/2018 | Yoshihira et al. | |
| 10,106,951 | B2 * | 10/2018 | Myers | E02F 3/34 |
| 10,168,165 | B2 * | 1/2019 | Lewis | G01C 21/3407 |
| 10,435,868 | B2 | 10/2019 | Tsuji et al. | |
| 2005/0000703 | A1 * | 1/2005 | Furuno | G01G 19/08 172/2 |
| 2011/0318156 | A1 | 12/2011 | Saito et al. | |
| 2012/0296531 | A1 | 11/2012 | Hyodo et al. | |
| 2013/0054133 | A1 * | 2/2013 | Lewis | G01C 21/3667 701/423 |
| 2014/0019042 | A1 * | 1/2014 | Sugawara | G01S 19/45 701/431 |
| 2014/0257647 | A1 | 9/2014 | Wu et al. | |
| 2014/0261152 | A1 * | 9/2014 | Tanaka | E02F 9/205 116/230 |
| 2014/0288771 | A1 * | 9/2014 | Li | E02F 9/205 701/34.4 |
| 2014/0338235 | A1 * | 11/2014 | Ryan | E02F 3/435 701/50 |
| 2016/0223350 | A1 * | 8/2016 | Lewis | G08G 1/096725 |
| 2018/0038702 | A1 * | 2/2018 | Lewis | G01C 21/3407 |
| 2018/0080193 | A1 | 3/2018 | Myers | |
| 2018/0118144 | A1 | 5/2018 | Yoshihira et al. | |
| 2018/0171594 | A1 | 6/2018 | Tsuji et al. | |
| 2018/0370432 | A1 | 12/2018 | Imaizumi et al. | |
| 2019/0093311 | A1 | 3/2019 | Naito | |
| 2020/0340205 | A1 | 10/2020 | Naito | |

FOREIGN PATENT DOCUMENTS

| | | | |
|---|---|---|---|
| CN | 107533803 | A | 1/2018 |
| EP | 3412837 | A1 | 12/2018 |
| GB | 2332415 | A | 6/1999 |
| JP | H10-88625 | A | 4/1998 |
| JP | H11-310939 | A | 11/1999 |
| JP | H11-350534 | A | 12/1999 |
| JP | 2000-136549 | A | 5/2000 |
| JP | 2008-248523 | A | 10/2008 |
| JP | 2016-089389 | A | 5/2016 |
| WO | 2010/104138 | A1 | 9/2010 |
| WO | 2011/074583 | A1 | 6/2011 |
| WO | 2016/058625 | A1 | 4/2016 |
| WO | 2018/043091 | A1 | 3/2018 |
| WO | 2018/043104 | A1 | 3/2018 |
| WO | 2018/146782 | A1 | 8/2018 |

OTHER PUBLICATIONS

International Search Report dated May 21, 2019, issued for PCT/JP2019/009791.

* cited by examiner

LOADING MACHINE CONTROL DEVICE AND LOADING MACHINE CONTROL METHOD

FIELD

The present invention relates to a loading machine control device and a loading machine control method.

BACKGROUND

A loading machine is used at a work site. Patent Literature 1 discloses an example of an automatic excavator including a measuring instrument for obtaining a distance to an excavation target and a loading target.

CITATION LIST

Patent Literature

Patent Literature 1: Japanese Laid-open Patent Publication No. 10-088625

SUMMARY

Technical Problem

In a case where automation of loading work by a loading machine is to be achieved, a technique capable of favorably measuring relative positions of the loading machine and a loading target is required.

An object of an aspect of the present invention is to favorably measure relative positions of a loading machine and a loading target.

Solution to Problem

According to an aspect of the present invention, a loading machine control device comprises: a measurement data acquisition unit that acquires measurement data of a measurement device mounted in a loading machine that has working equipment; a target calculation unit that calculates, on the basis of the measurement data, a position of an upper end portion of a loading target to which an excavation object excavated by a bucket of the working equipment is loaded; a bucket calculation unit that calculates position data of the bucket; an overlap determination unit that determines whether or not the upper end portion of the loading target and the bucket that are in the measurement data overlap each other; and a working equipment control unit that controls the working equipment on the basis of the measured position of the upper end portion of the loading target when it is determined that the upper end portion of the loading target and the bucket that are in the measurement data do not overlap each other.

Advantageous Effects of Invention

According to an aspect of the present invention, it is possible to favorably measure relative positions of a loading machine and a loading target.

DESCRIPTION OF EMBODIMENTS

Although embodiments according to the present invention will be described below with reference to the drawings, the present invention is not limited to this. Components of the embodiments that will be described below may be combined as appropriate. Furthermore, there may be a case where a part of the components is not used.

[Wheel Loader]

Figure 1:
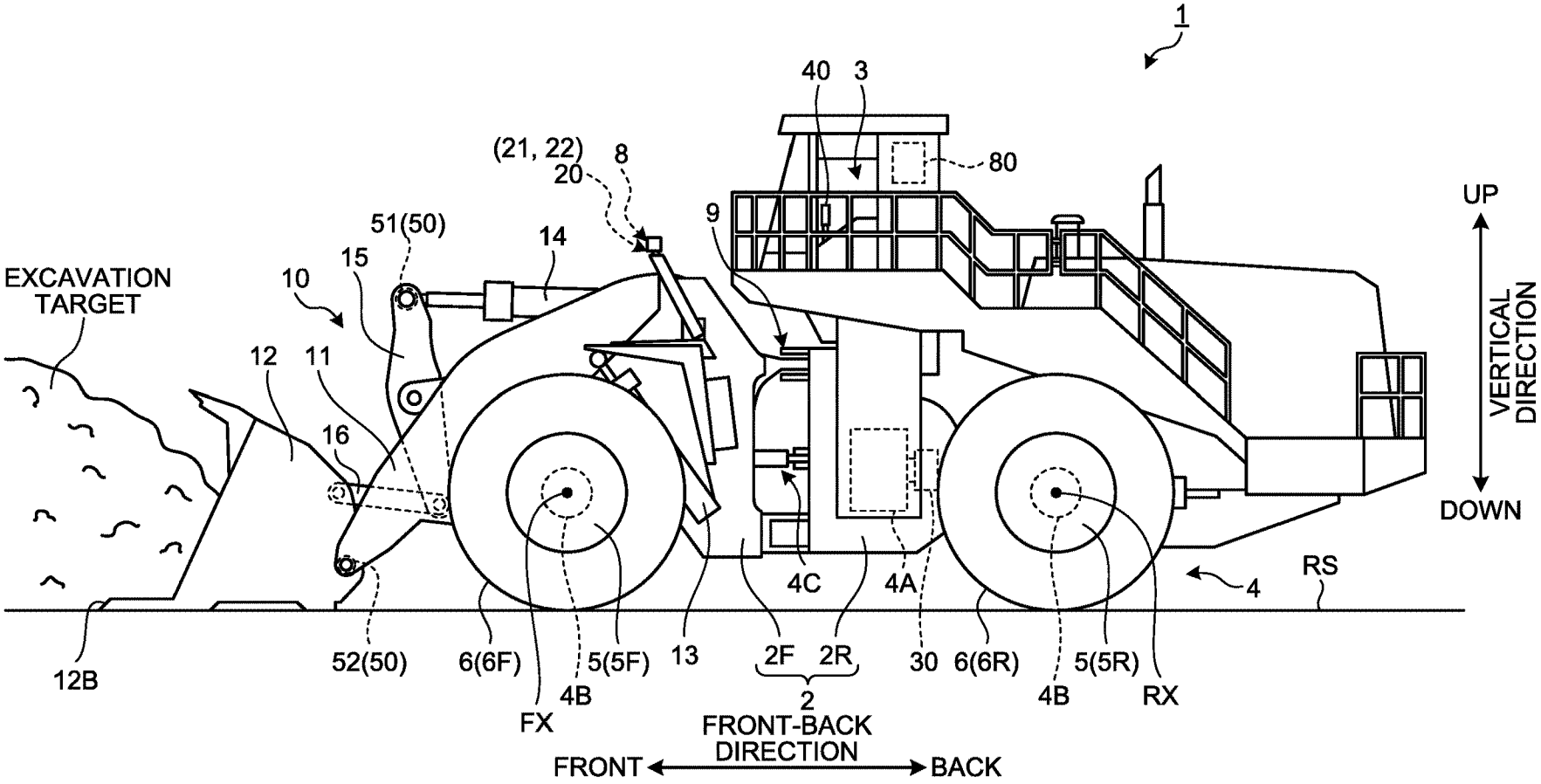
FIG. 1 is a side view illustrating a loading machine according to the present embodiment.

FIG. 1 is a side view illustrating an example of a loading machine 1 according to the present embodiment. The loading machine 1 performs predetermined work at a work site. In the present embodiment, the loading machine 1 is assumed to be a wheel loader 1 that is a kind of an articulated loading machine. The predetermined work includes excavation work and loading work. A work target includes an excavation target and a loading target. The wheel loader 1 performs excavation work for excavating the excavation target and loading work for loading an excavation object excavated by the excavation work to the loading target. Concept of the loading work includes discharging work for discharging an excavation object to a discharging target. As the excavation target, at least one of a rock mass, a rock heap, coal, or a wall surface is exemplified. The rock mass is a heap including sediment. The rock heap is a heap including rock or stone. As the loading target, at least one of a transportation vehicle, a predetermined area of the work site, a hopper, a belt conveyor, or a crusher is exemplified.

As illustrated in FIG. 1, the wheel loader 1 includes a vehicle body 2, a cab 3 provided with a driver seat, a travel device 4 that supports the vehicle body 2, working equipment 10 supported by the vehicle body 2, an angle sensor 50 that detects an angle of the working equipment 10, a transmission device 30, a three-dimensional measurement device 20 that measures a measurement target ahead of the vehicle body 2, and a control device 80.

The vehicle body 2 includes a vehicle body front part 2F and a vehicle body rear part 2R. The vehicle body front part 2F and the vehicle body rear part 2R are bendably coupled via a joint mechanism 9.

The cab 3 is supported by the vehicle body 2. At least a part of the wheel loader 1 is operated by a driver on the cab 3.

The travel device 4 supports the vehicle body 2. The travel device 4 has wheels 5. The wheels 5 rotate by driving force generated by an engine mounted in the vehicle body 2. Tires 6 are fitted on the wheels 5. The wheels 5 include two front wheels 5F fitted on the vehicle body front part 2F and two rear wheels 5R fitted on the vehicle body rear part 2R. The tires 6 include front tires 6F fitted on the front wheels 5F and rear tires 6R fitted on the rear wheels 5R. The travel device 4 can travel on ground RS.

The front wheels 5F and the front tires 6F are rotatable around a rotation shaft FX. The rear wheels 5R and the rear tires 6R are rotatable around a rotation shaft RX.

In the following description, a direction parallel to the rotation shaft FX of the front wheels 5F is referred to as a vehicle width direction as appropriate, a direction orthogonal to a ground contact surface of the front tires 6F, which contacts the ground RS, is referred to as a vertical direction as appropriate, and a direction orthogonal to both the vehicle width direction and the vertical direction is referred to as a front-back direction as appropriate. When the vehicle body 2 of the wheel loader 1 travels straight, the rotation shaft FX and the rotation shaft RX are parallel to each other.

The travel device 4 has a drive device 4A, a brake device 4B, and a steering device 4C. The drive device 4A generates driving force for accelerating the wheel loader 1. The drive device 4A includes an internal combustion engine such as a diesel engine. The driving force generated by the drive device 4A is transmitted to the wheels 5 via the transmission device 30, and the wheels 5 rotate. The brake device 4B generates braking force for decelerating or stopping the wheel loader 1. The steering device 4C can adjust a travel direction of the wheel loader 1. The travel direction of the wheel loader 1 includes orientation of the vehicle body front part 2F. The steering device 4C adjusts the travel direction of the wheel loader 1 by bending the vehicle body front part 2F with a hydraulic cylinder.

In the present embodiment, the travel device 4 is operated by the driver on the cab 3. The working equipment 10 is controlled by the control device 80. A travel operation device 40 for operating the travel device 4 is placed on the cab 3. The driver operates the travel operation device 40 to activate the travel device 4. The travel operation device 40 includes an accelerator pedal, a brake pedal, a steering lever, and a shift lever 41 that is for switching between forward and backward movement. By the accelerator pedal being operated, travel speed of the wheel loader 1 increases. By the brake pedal being operated, travel speed of the wheel loader 1 decreases or travel is stopped. By the steering lever being operated, the wheel loader 1 swings. By the shift lever 41 being operated, forward movement or backward movement of the wheel loader 1 is switched.

The transmission device 30 transmits the driving force generated in the drive device 4A to the wheels 5.

The working equipment 10 has a boom 11 rotatably coupled to the vehicle body front part 2F, and a bucket 12, a bell crank 15, and a link 16 that are rotatably coupled to the boom 11.

The boom 11 is activated by power generated by a boom cylinder 13. By the boom cylinder 13 extends and contracts, the boom 11 performs rising motion or falling motion.

The bucket 12 is a work member having a tip portion 12B including a cutting edge. The bucket 12 is placed ahead of the front wheels 5F. The bucket 12 is coupled to a tip portion of the boom 11. The bucket 12 is activated by power generated by a bucket cylinder 14. By the bucket cylinder 14 extends and contracts, the bucket 12 performs dumping motion or tilting motion.

By dumping motion by the bucket 12 is performed, an excavation object scooped up by the bucket 12 is discharged from the bucket 12. By tilting motion by the bucket 12 is performed, the bucket 12 scoops an excavation object.

The angle sensor 50 detects an angle of the working equipment 10. The angle sensor 50 includes a boom angle sensor 51 that detects an angle of the boom 11 and a bucket angle sensor 52 that detects an angle of the bucket 12. The boom angle sensor 51 detects an angle of the boom 11 with respect to a reference axis of a vehicle body coordinate system specified to the vehicle body front part 2F, for example. The bucket angle sensor 52 detects an angle of the bucket 12 with respect to the boom 11. The angle sensor 50 may be a potentiometer or a stroke sensor that detects stroke of the hydraulic cylinder.

[Three-Dimensional Measurement Device]

The three-dimensional measurement device 20 is mounted in the wheel loader 1. The three-dimensional measurement device 20 is supported by a housing 17. The three-dimensional measurement device 20 measures a measurement target ahead of the vehicle body front part 2F. The measurement target includes a loading target in which an excavation object excavated by the working equipment 10 is loaded. The three-dimensional measurement device 20 measures a three-dimensional shape of the measurement target. The three-dimensional measurement device 20 measures relative positions from the three-dimensional measurement device 20 to each of a plurality of measurement points on a surface of the measurement target, and measures a three-dimensional shape of the measurement target. The control device 80 calculates a parameter related to the loading target on the basis of the measured three-dimensional shape of the loading target. The parameter related to the loading target includes at least one of a distance to the loading target, a position of an upper end portion of the loading target, and height of the loading target.

Relative positions of the wheel loader 1 and the measurement target include relative distances (three-dimensional distances) between the wheel loader 1 and the measurement target. The three-dimensional measurement device 20 can measure a three-dimensional shape of the measurement target and relative positions with the measurement target by measuring distances to each of the plurality of measurement points on the surface of the measurement target.

The three-dimensional measurement device 20 includes a laser radar 21 that is a kind of a laser measurement device and a stereo camera 22 that is a kind of a photographic measurement device.

Measurement data acquired by the laser radar 21 is output to the control device 80. The control device 80 measures a three-dimensional shape of the measurement target on the basis of the measurement data by the laser radar 21.

The stereo camera 22 images the measurement target and measures the measurement target. The stereo camera 22 has a first camera 22A and a second camera 22B. Image data acquired by the first camera 22A and image data acquired by the second camera 22B are output to the control device 80. The control device 80 performs stereo processing on the basis of the image data acquired by the first camera 22A and the image data acquired by the second camera 22B, and measures a three-dimensional shape of the measurement target. The image data is an example of measurement data.

[Motion]

Figure 2:
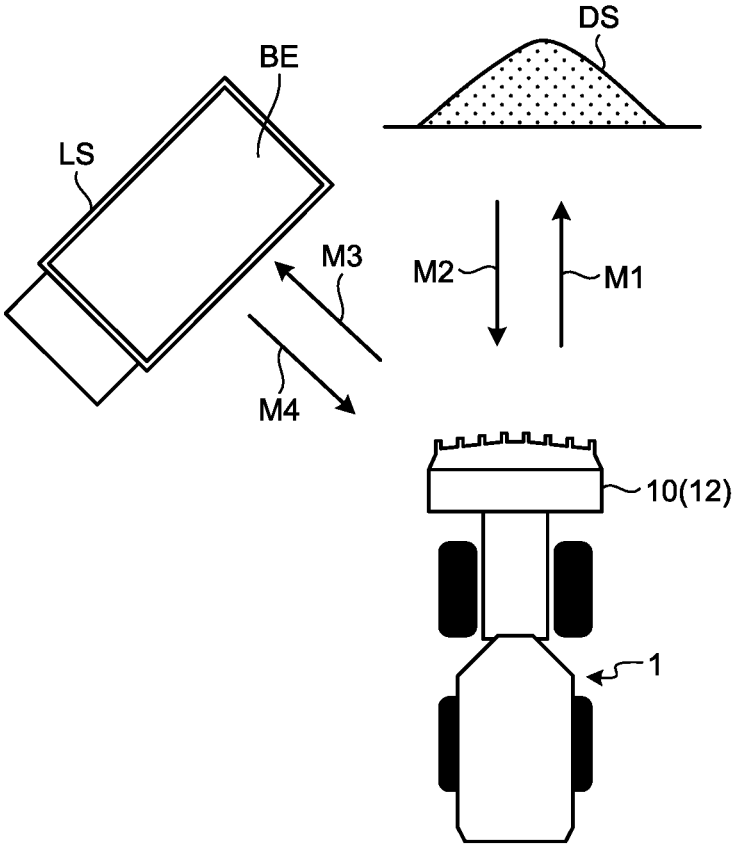
FIG. 2 is a schematic diagram illustrating motion of the loading machine according to the present embodiment.

FIG. 2 is a schematic diagram illustrating motion of the wheel loader 1 according to the present embodiment. The wheel loader 1 works in a plurality of work modes. The work modes include an excavation work mode in which the bucket 12 of the working equipment 10 excavates an excavation target, and a loading work mode in which the excavation object scooped by the bucket 12 in the excavation work mode is loaded to the loading target. As the excavation target, a rock mass DS placed on the ground RS is exemplified. As the loading target, a vessel BE of a transportation vehicle LS capable of traveling on ground is exemplified. As the transportation vehicle LS, a dump truck is exemplified.

In the excavation work mode, the wheel loader 1 moves forward toward the rock mass DS in order to excavate the rock mass DS with the bucket 12 of the working equipment 10 in a state where no excavation object is held in the bucket 12 of the working equipment 10. A driver of the wheel loader 1 operates the travel operation device 40 to move the wheel loader 1 forward to approach the rock mass DS, as indicated by an arrow M1 in FIG. 2. The control device 80 controls the working equipment 10 so that the rock mass DS is excavated by the bucket 12.

After the rock mass DS is excavated by the bucket 12 and the excavation object is scooped by the bucket 12, the wheel loader 1 moves backward to be separated from the rock mass DS in a state where the excavation object is held in the bucket 12 of the working equipment 10. The driver of the wheel loader 1 operates the travel operation device 40 to move the wheel loader 1 backward to be away from the rock mass DS, as indicated by an arrow M2 in FIG. 2.

Next, the loading work mode is performed. In the loading work mode, the wheel loader 1 moves forward toward the transportation vehicle LS in order to load the excavation object excavated by the bucket 12 of the working equipment 10 in a state where the excavation object is held in the bucket 12 of the working equipment 10. The driver of the wheel loader 1 operates the travel operation device 40 to move the wheel loader 1 forward, while swinging the wheel loader 1, to approach the transportation vehicle LS, as indicated by an arrow M3 in FIG. 2. The three-dimensional measurement device 20 mounted in the wheel loader 1 measures the transportation vehicle LS. The control device 80 controls the working equipment 10 on the basis of the measurement data in the three-dimensional measurement device 20 so that the excavation object held by the bucket 12 is loaded to the vessel BE of the transportation vehicle LS. That is, the control device 80 controls the working equipment 10 so that the boom 11 performs rising motion in a state where the wheel loader 1 is moving forward so as to approach the transportation vehicle LS. After the boom 11 performs rising motion and the bucket 12 is placed above the vessel BE, the control device 80 controls the working equipment 10 so that the bucket 12 performs tilting motion. With this arrangement, the excavation object is discharged from the bucket 12 and loaded to the vessel BE.

After the excavation object is discharged from the bucket 12 and loaded to the vessel BE, the wheel loader 1 moves backward to be separated from the transportation vehicle LS in a state where no excavation object is held in the bucket 12 of the working equipment 10. The driver operates the travel operation device 40 to move the wheel loader 1 backward to be away from the transportation vehicle LS, as indicated by an arrow M4 in FIG. 2.

The driver and the control device 80 repeat the above-described motion until the vessel BE is fully loaded with an excavation object.

Figure 3:
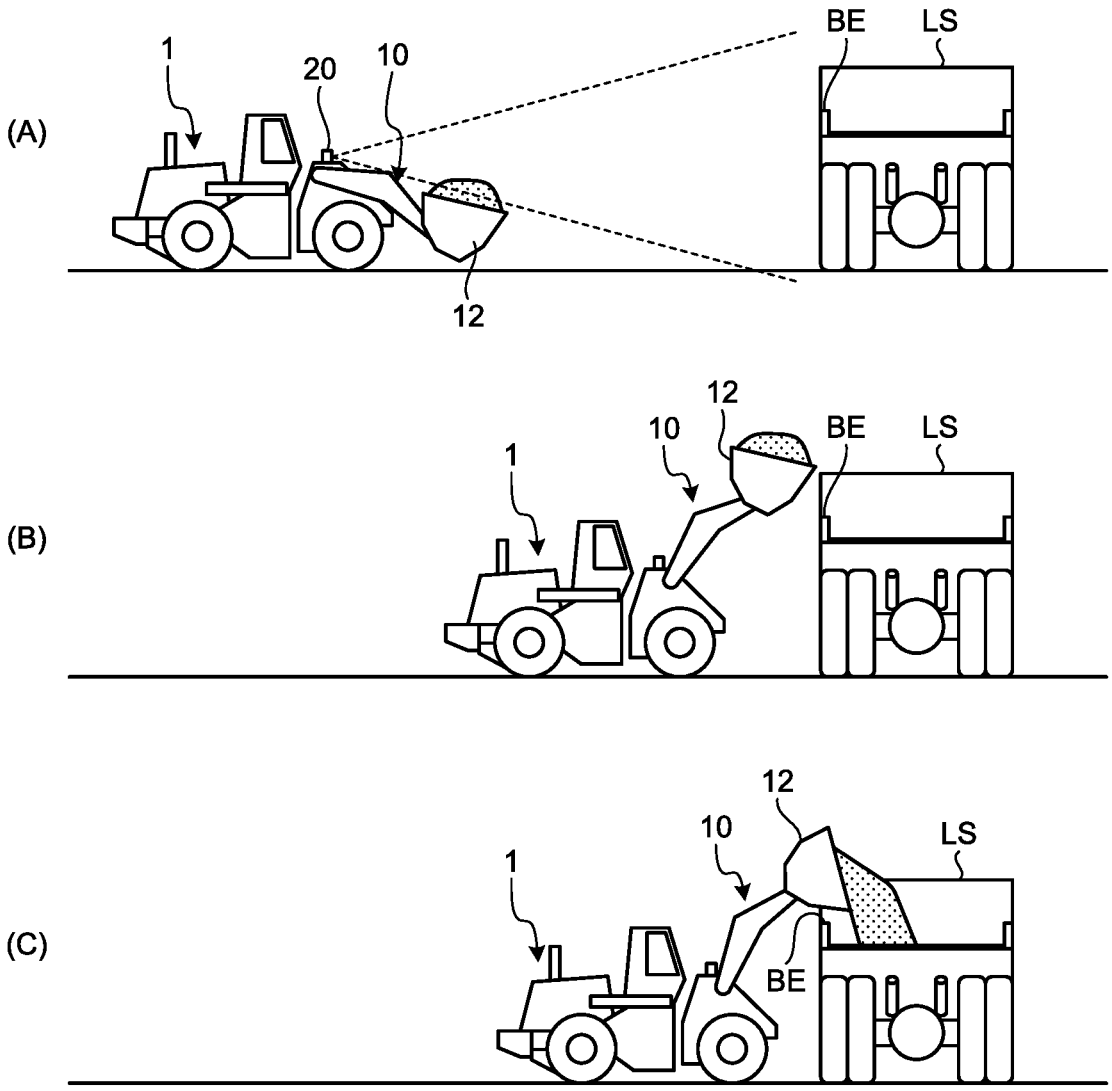
FIG. 3 is a schematic diagram illustrating a loading work mode of the loading machine according to the present embodiment.

FIG. 3 is a schematic diagram illustrating the loading work mode of the wheel loader 1 according to the present embodiment. The driver of the wheel loader 1 operates the travel operation device 40 to move the wheel loader 1 forward to approach the transportation vehicle LS. As illustrated in FIG. 3(A), the three-dimensional measurement device 20 mounted in the wheel loader 1 measures a three-dimensional shape of the transportation vehicle LS. The control device 80 detects a distance between the wheel loader 1 and the transportation vehicle LS and height of an upper end portion of the vessel BE on the basis of the measurement data in the three-dimensional measurement device 20. The distance from the wheel loader 1 to the transportation vehicle LS includes a distance from the tip portion 12B of the bucket 12 to the transportation vehicle LS, a distance from any point of the bucket 12 to the transportation vehicle LS, a distance from any point of a main body of the wheel loader 1 to the transportation vehicle LS, and a distance from the three-dimensional measurement device 20 to the transportation vehicle LS. The distance from the tip portion 12B of the bucket 12 includes a distance from a central portion of the tip portion 12B and a distance from any one point of both ends of the tip portion 12B. The distance from the wheel loader 1 to the transportation vehicle LS includes a distance extending from the tip portion 12B of the bucket 12 in a traveling direction of the vehicle body front part 2F to a point crossing the transportation vehicle LS, and a shortest distance from the tip portion 12B of the bucket 12 to the transportation vehicle LS. The distance from the wheel loader 1 to the transportation vehicle LS includes a horizontal distance and a distance in a direction parallel to the ground RS. Furthermore, the distance to the transportation vehicle LS includes a distance to a closest point of the transportation vehicle LS, that is, a point closest on a wheel loader 1 side of the transportation vehicle LS.

As illustrated in FIG. 3 (B), in a state where the wheel loader 1 is moving forward to approach the transportation vehicle LS, the control device 80, on the basis of the measurement data in the three-dimensional measurement device 20, causes the boom 11 to perform rising motion, by controlling an angle of the bucket 12 so that the bucket 12 is placed above the upper end portion of the vessel BE and that the excavation object held by the bucket 12 does not spill out of the bucket 12.

As illustrated in FIG. 3(C), after the boom 11 performs rising motion and the bucket 12 is placed above the vessel BE, the control device 80 controls the working equipment 10 so that the bucket 12 performs tilting motion. With this arrangement, the excavation object is discharged from the bucket 12 and loaded to the vessel BE.

Figure 4:
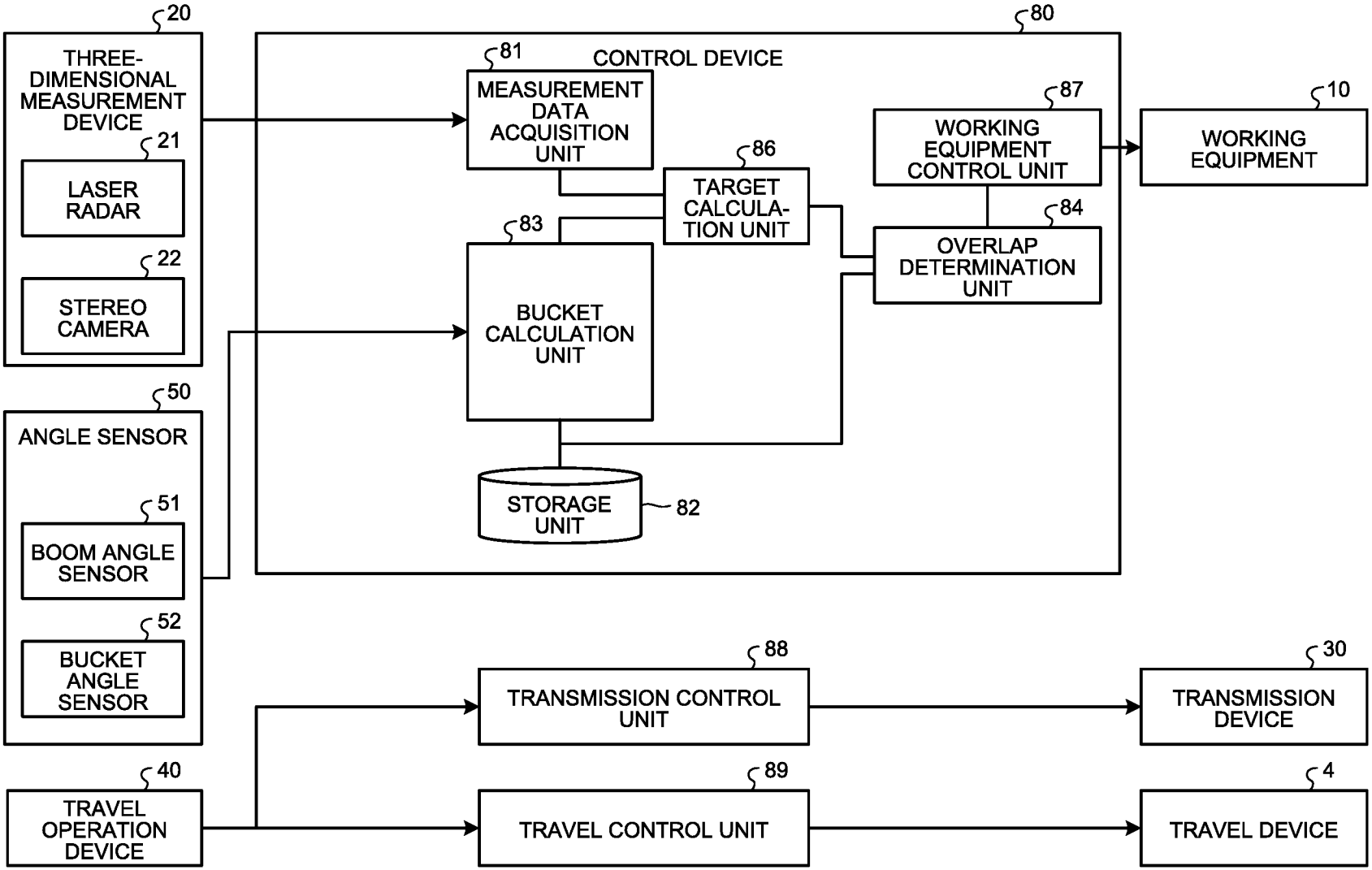
FIG. 4 is a functional block diagram illustrating a loading machine control device according to the present embodiment.

[Control Device] FIG. 4 is a functional block diagram illustrating the control device 80 of the wheel loader 1 according to the present embodiment. The control device 80 includes a computer system.

The working equipment 10, the transmission device 30, the travel device 4, the three-dimensional measurement device 20, the angle sensor 50, and the travel operation device 40 are connected to the control device 80.

The control device 80 has a measurement data acquisition unit 81, a storage unit 82, a bucket calculation unit 83, a target calculation unit 86, an overlap determination unit 84, and a working equipment control unit 87.

The measurement data acquisition unit 81 acquires measurement data in the three-dimensional measurement device 20 from the three-dimensional measurement device 20. The three-dimensional measurement device 20 outputs the measurement data to the control device 80.

Furthermore, the storage unit 82 stores working equipment data. The working equipment data includes design data or specification data of the working equipment 10. The design data of the working equipment 10 includes, for example, computer aided design (CAD) data of the working equipment 10. The working equipment data includes outer shape data of the working equipment 10. The outer shape data of the working equipment 10 includes dimension data of the working equipment 10. In the present embodiment, the working equipment data includes data of boom length, bucket length, and an outer shape of the bucket. The boom length refers to a distance between a boom rotation shaft and a bucket rotation shaft. The bucket length refers to a distance between the bucket rotation shaft and the tip portion 12B of the bucket 12. The boom rotation shaft refers to a rotation shaft of the boom 11 with respect to the vehicle body front part 2F, and includes a coupling pin that couples the vehicle body front part 2F and the boom 11. The bucket rotation shaft refers to a rotation shaft of the bucket 12 with respect to the boom 11, and includes a coupling pin that couples the boom 11 and the bucket 12. The outer shape of the bucket includes a shape and dimensions of the bucket 12. The dimensions of the bucket 12 include a bucket width that indicates a distance between a left end and a right end of the bucket 12, height of an opening of the bucket 12, length of a bottom surface of the bucket, and the like.

The bucket calculation unit 83 calculates position data of the working equipment 10 on the basis of angle data of the working equipment 10 detected by the angle sensor 50 and the working equipment data of the working equipment 10, the working equipment data being stored in the storage unit 82. The bucket calculation unit 83 calculates position data of the bucket 12 in a vehicle body coordinate system, for example. The bucket calculation unit 83 calculates at least a position of the tip portion 12B of the bucket 12 and a position and height of a lower end portion 12E of the bucket 12.

On the basis of the measurement data acquired by the measurement data acquisition unit 81, the target calculation unit 86 calculates three-dimensional data of the transportation vehicle LS including the vessel BE, three-dimensional data being measured by the three-dimensional measurement device 20. The three-dimensional data of the transportation vehicle LS indicates a three-dimensional shape of the transportation vehicle LS.

The target calculation unit 86 calculates a parameter related to the transportation vehicle LS on the basis of the three-dimensional data of the transportation vehicle LS. The parameter related to the transportation vehicle LS includes at least one of the distance from the wheel loader 1 to the transportation vehicle LS and height of an upper end portion BEt of the vessel BE. The height of the upper end portion BEt of the vessel BE is an example of the position of the upper end portion of the loading target, the height of the loading target, a position of the upper end portion of the transportation vehicle LS, and height of the transportation vehicle LS.

The overlap determination unit 84 determines whether or not the upper end portion BEt of the vessel BE and the bucket 12 overlap each other in the measurement data.

On the basis of relative positions of a position of the three-dimensional measurement device 20, a position of the upper end portion BEt of the vessel BE, and the bucket 12, the overlap determination unit 84 determines whether or not the upper end portion BEt of the vessel BE and the bucket 12 overlap each other.

When it is determined in the overlap determination unit 84 that the upper end portion BEt of the vessel BE and the bucket 12 do not overlap each other, the target calculation unit 86 calculates the height of the upper end portion BEt of the vessel BE.

In the present embodiment, the bucket calculation unit 83 calculates a position of the bucket 12 in a vehicle body coordinate system of the wheel loader 1. When an angle specified on the basis of the position of the three-dimensional measurement device 20, a position of the upper end portion BEt of the vessel BE, and a position of a lower end portion of the bucket 12 is equal to or larger than a predetermined angle, the target calculation unit 86 calculates the position of the upper end portion BEt of the vessel BE.

On the basis of the distance to the transportation vehicle LS and height of the upper end portion BEt of the vessel BE that are calculated by the target calculation unit 86, the working equipment control unit 87 controls motion of the working equipment 10 for loading the excavation object to the vessel BE. When it is determined in the overlap determination unit 84 that the upper end portion BEt of the vessel BE and the bucket 12 do not overlap each other, the working equipment control unit 87 calculates the working equipment 10 on the basis of the position of the upper end portion BEt of the vessel BE.

Control of motion of the working equipment 10 includes control of motion of at least one of the boom cylinder 13 and the bucket cylinder 14. The wheel loader 1 has a hydraulic pump, a boom control valve that controls a flow rate and direction of hydraulic oil supplied from the hydraulic pump to the boom cylinder 13, and a bucket control valve that controls a flow rate and direction of hydraulic oil supplied from the hydraulic pump to the bucket cylinder 14. The working equipment control unit 87 can output a control signal to the boom control valve and the bucket control valve, control the flow rate and direction of the hydraulic oil supplied to the boom cylinder 13 and the bucket cylinder 14, and control rising/falling motion of the boom 11 and rising/falling motion of the bucket 12.

In the present embodiment, the target calculation unit 86 removes partial data that indicates at least a part of the working equipment 10 from the measurement data on the basis of the position data of the working equipment 10 calculated by the bucket calculation unit 83, and calculates the height data of the upper end portion BEt of the vessel BE and distance data to the transportation vehicle LS on the basis of the measurement data from which the partial data is removed.

In the present embodiment, the wheel loader 1 has a transmission control unit 88 and a travel control unit 89.

The transmission control unit 88 controls motion of the transmission device 30 on the basis of operation of the travel operation device 40 by the driver of the wheel loader 1. Control of motion of the transmission device 30 includes control of a shift change.

The travel control unit 89 controls motion of the travel device 4 on the basis of operation of the travel operation device 40 by the driver of the wheel loader 1. The travel control unit 89 outputs an operation command including an acceleration command for activating the drive device 4A, a brake command for activating the brake device 4B, and a steering command for activating the steering device 4C.

[Processing of Working Equipment Control Unit]

In the present embodiment, on the basis of a position of the upper end portion of the vessel BE calculated by the target calculation unit 86 and the position of the lower end portion of the bucket 12 calculated by the bucket calculation unit 83, the working equipment control unit 87 determines whether or not relative positions of the upper end portion of the vessel BE and the lower end portion of the bucket 12 satisfy a specified condition.

Figure 5:
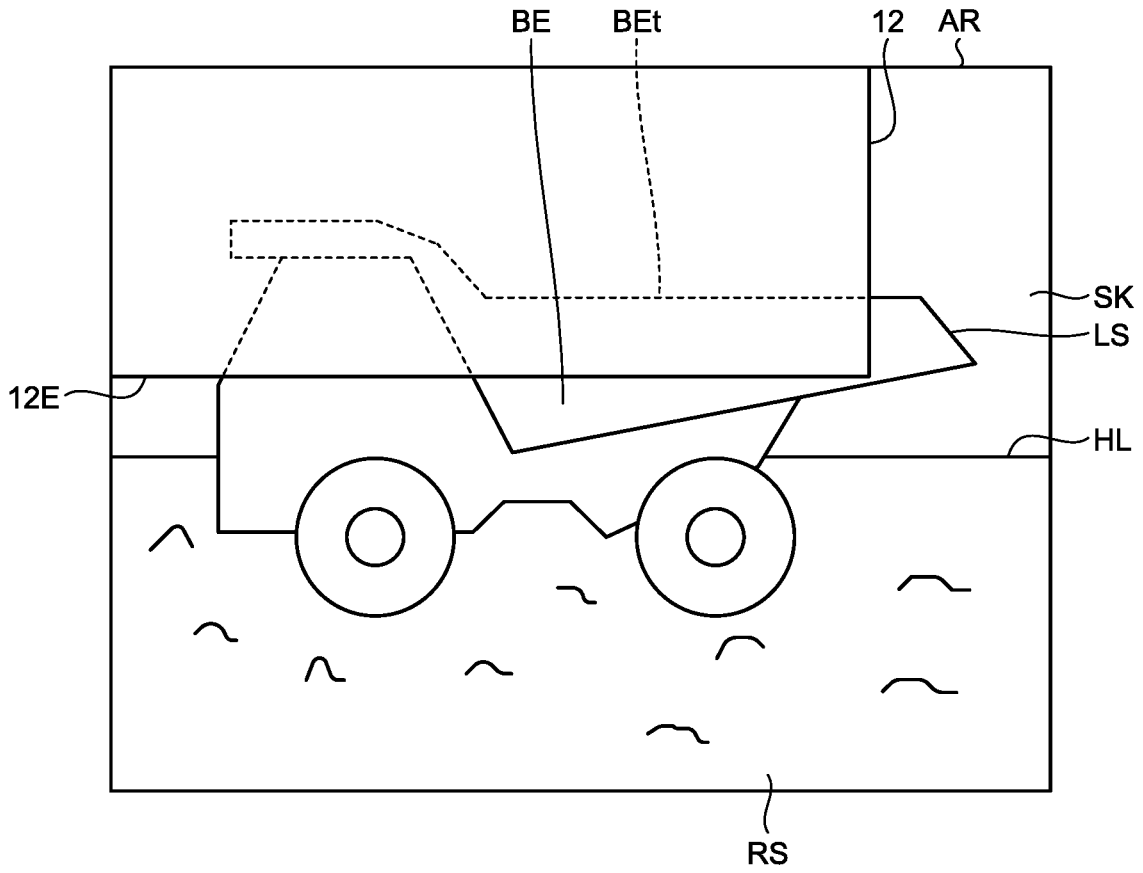
FIG. 5 is a diagram illustrating an example of a measurement range of a three-dimensional measurement device according to the present embodiment.
Figure 6:
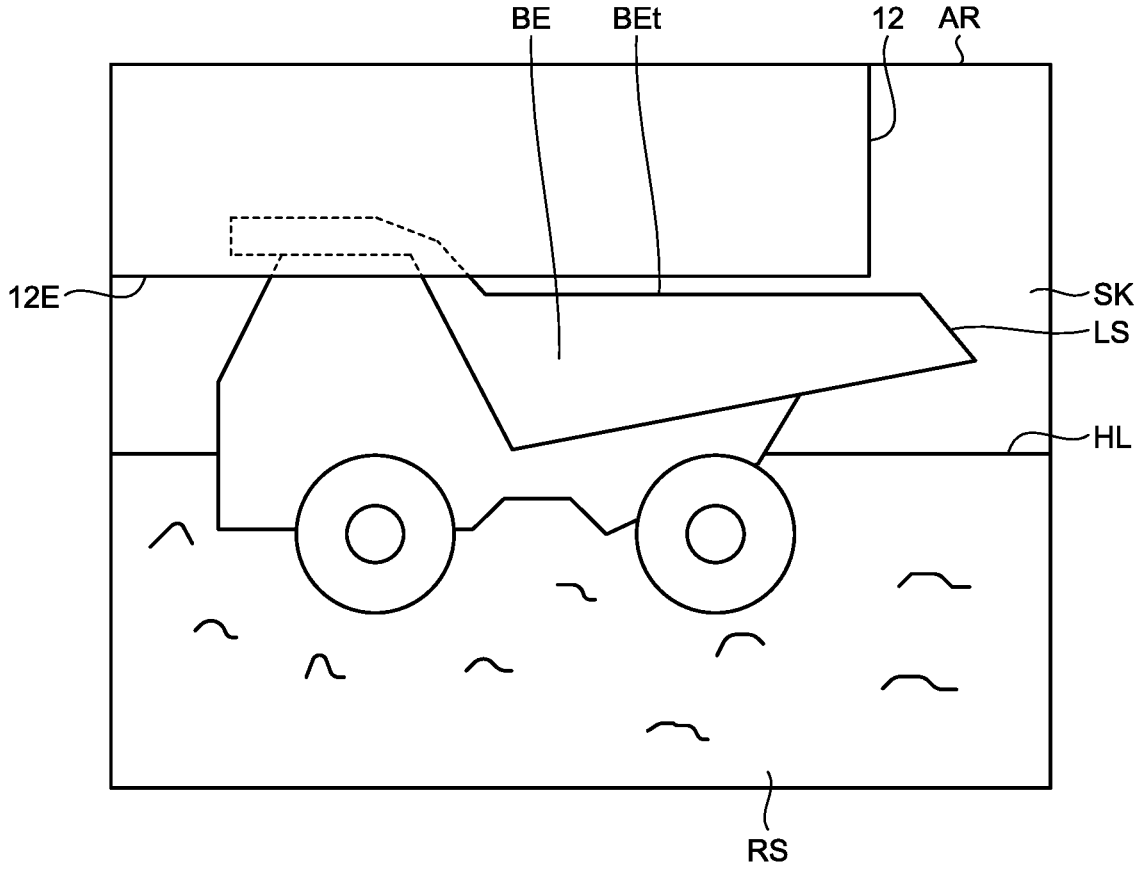
FIG. 6 is a diagram illustrating an example of a measurement range of the three-dimensional measurement device according to the present embodiment.
Figure 7:
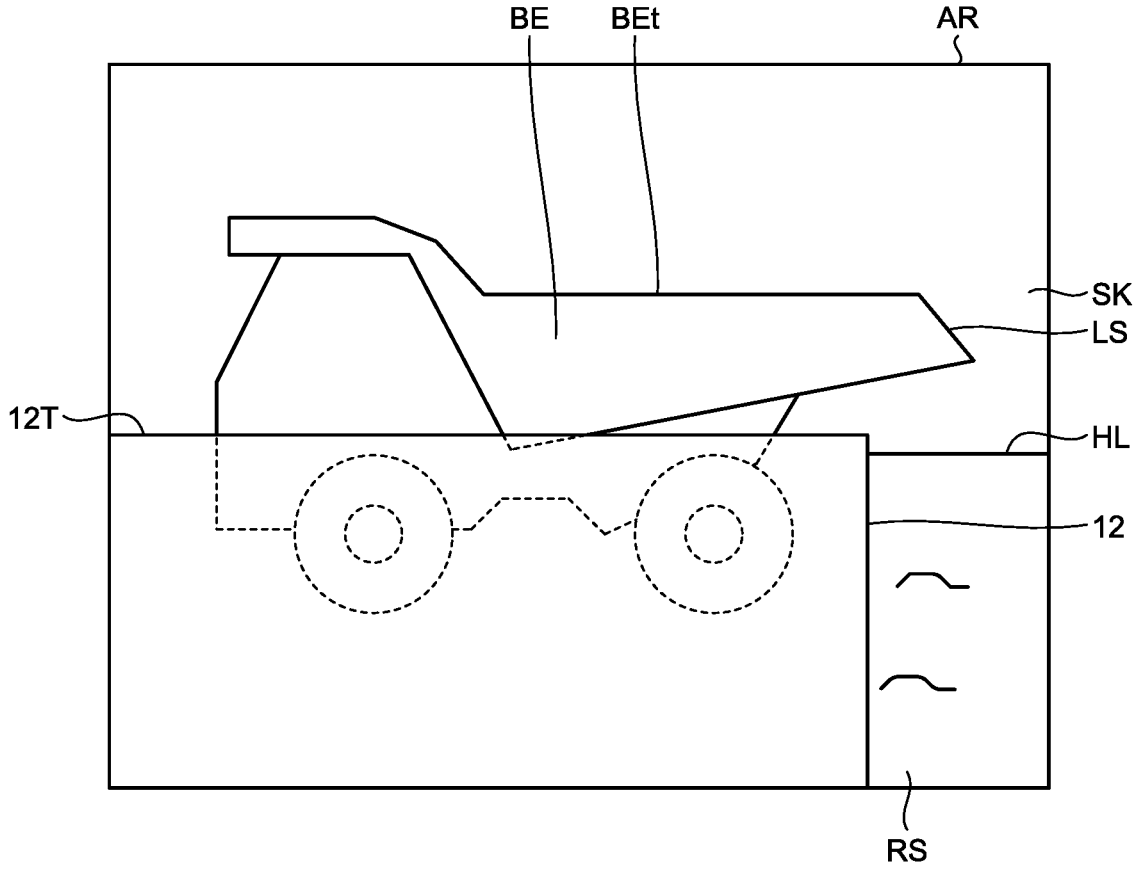
FIG. 7 is a diagram illustrating an example of a measurement range of the three-dimensional measurement device according to the present embodiment.

FIGS. 5, 6, and 7 are diagrams illustrating a measurement range in the stereo camera 22 as an example of a measurement range AR of the three-dimensional measurement device 20. When measuring a measurement target by using the three-dimensional measurement device 20, there is a possibility that at least a part of the working equipment 10 is placed within the measurement range AR of the three-dimensional measurement device 20. In a case where the three-dimensional measurement device 20 is the stereo camera 22, a measurement range of the three-dimensional measurement device 20 includes an imaging range of the stereo camera 22 (a field of view of an optical system of the stereo camera 22). In a case where the three-dimensional measurement device 20 is the laser radar 21, the measurement range of the three-dimensional measurement device 20 includes an irradiation range of laser light emitted from the laser radar 21.

The specified condition includes a condition in which the upper end portion of the vessel BE is placed within the measurement range AR of the three-dimensional measurement device 20 without being blocked by the bucket 12 of the working equipment 10.

FIG. 5 illustrates an example in which the bucket 12 is placed within the measurement range AR of the three-dimensional measurement device 20, and the lower end portion 12E of the bucket 12 is placed below the upper end portion of the vessel BE. As illustrated in FIG. 6, there may be a case where the upper end portion of the vessel BE is hidden by the bucket 12 depending on relative positions of the upper end portion of the vessel BE and the lower end portion 12E of the bucket 12.

FIG. 6 illustrates an example in which the lower end portion 12E of the bucket 12 is placed above the upper end portion of the vessel BE although the bucket 12 is placed within the measurement range AR of the three-dimensional measurement device 20. As illustrated in FIG. 6, there may be a case where the upper end portion of the vessel BE appears within the measurement range AR without being hidden by the bucket 12 depending on the relative positions of the upper end portion of the vessel BE and the lower end portion 12E of the bucket 12.

FIG. 7 illustrates an example in which the bucket 12 is placed within the measurement range AR of the three-dimensional measurement device 20, and an upper end portion 12T of the bucket 12 is placed below the upper end portion of the vessel BE. As illustrated in FIG. 7, there may be a case where the upper end portion of the vessel BE appears within the measurement range AR without being hidden by the bucket 12 depending on relative positions of the upper end portion of the vessel BE and the upper end portion 12T of the bucket 12.

In a case of a state illustrated in FIG. 5, the working equipment control unit 87 determines that the relative positions of the upper end portion of the vessel BE and the lower end portion of the bucket 12 do not satisfy a specified condition. When having determined that the specified condition is not satisfied, the working equipment control unit 87 controls motion of the working equipment 10 on the basis of, for example, a distance to a closest point that indicates a portion of the transportation vehicle LS, which is closest to the wheel loader 1 in a horizontal direction. It should be noted that the working equipment control unit 87 may cause the boom 11 to rise at predetermined rising speed on the basis of a distance between the three-dimensional measurement device 20 and the closest point of the transportation vehicle LS.

In a case of a state illustrated in FIG. 6, the working equipment control unit 87 determines that the relative positions of the upper end portion of the vessel BE and the lower end portion of the bucket 12 satisfy the specified condition. When having determined that the specified condition is satisfied, the working equipment control unit 87 controls motion of the working equipment 10 on the basis of, for example, the height of the upper end portion of the vessel BE and a distance between the wheel loader 1 and the closest point of the transportation vehicle LS.

In a case of a state illustrated in FIG. 7, the working equipment control unit 87 determines that the relative positions of the upper end portion of the vessel BE and the lower end portion of the bucket 12 satisfy the specified condition. When having determined that the specified condition is satisfied, the working equipment control unit 87 controls motion of the working equipment 10 on the basis of, for example, the height of the upper end portion of the vessel BE and a distance between the wheel loader 1 and the closest point of the transportation vehicle LS.

[Method for Determining Specified Condition]

Figure 8:
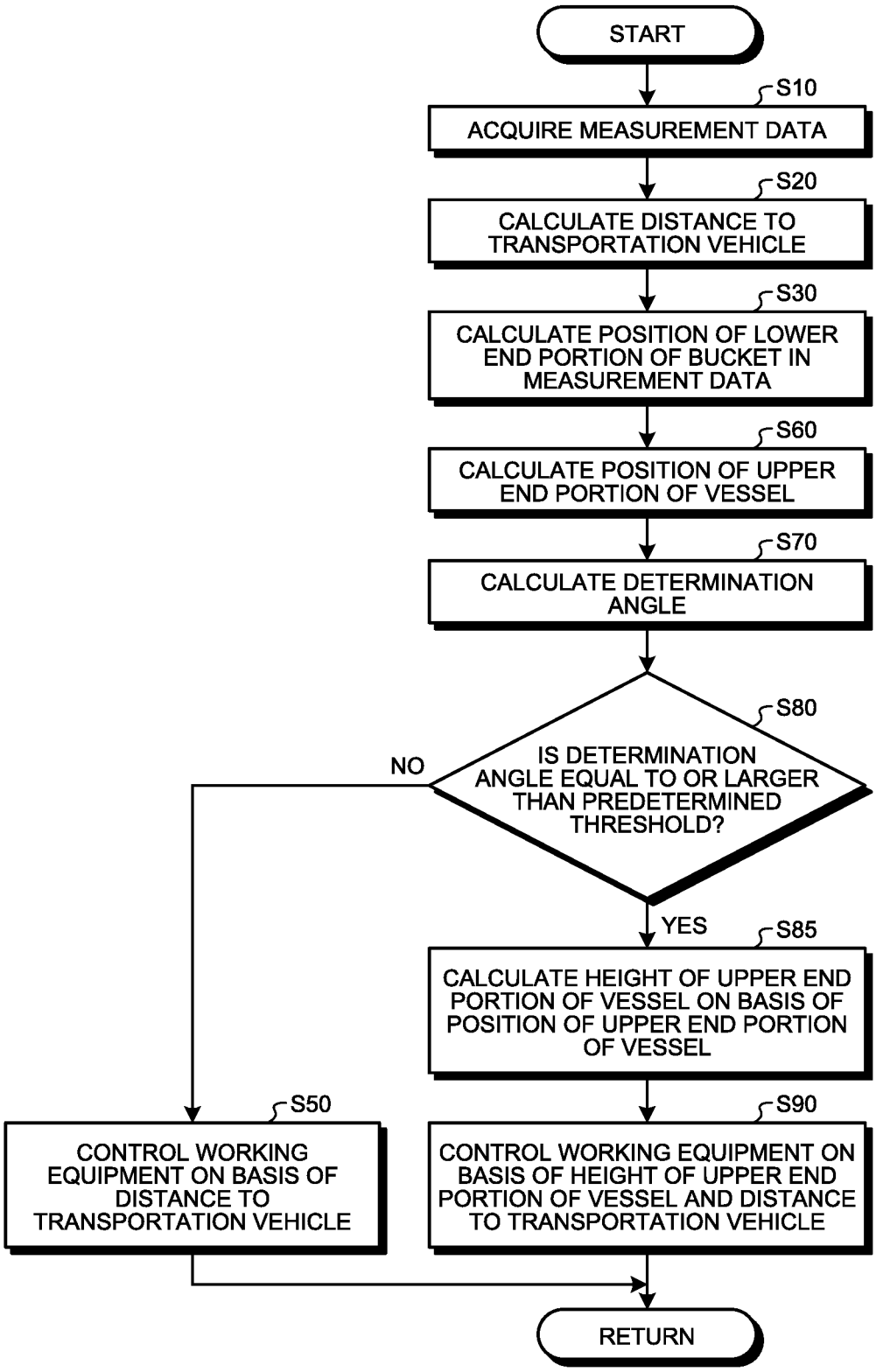
FIG. 8 is a flowchart illustrating a loading machine control method according to the present embodiment.
Figure 9:
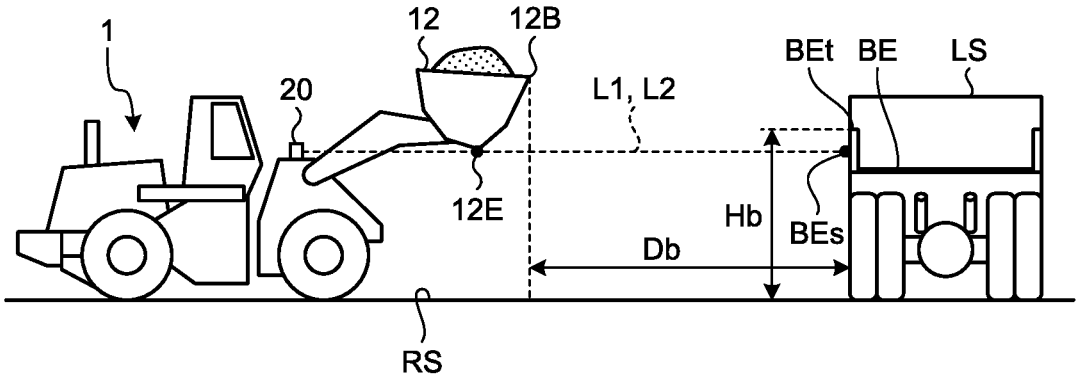
FIG. 9 is a diagram for describing a method for determining a specified condition according to the present embodiment.
Figure 10:
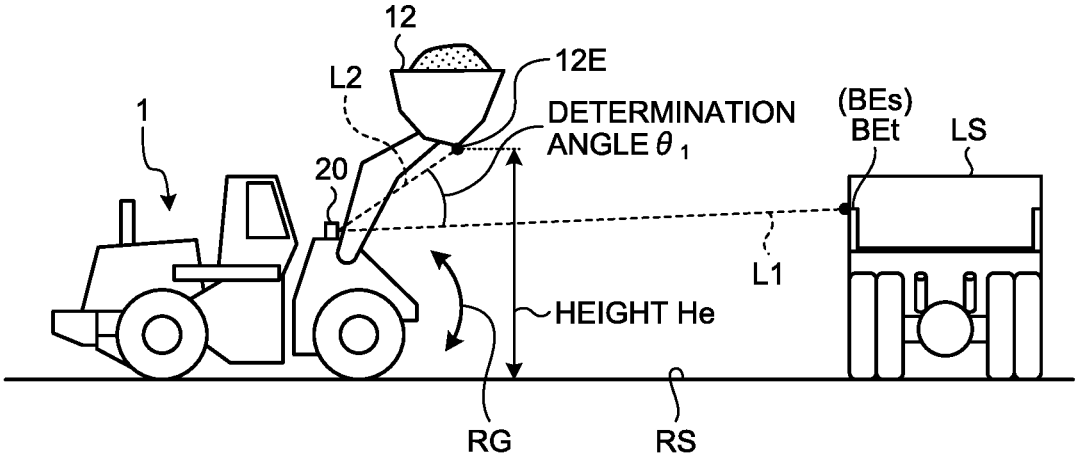
FIG. 10 is a diagram for describing a method for determining the specified condition according to the present embodiment.
Figure 11:
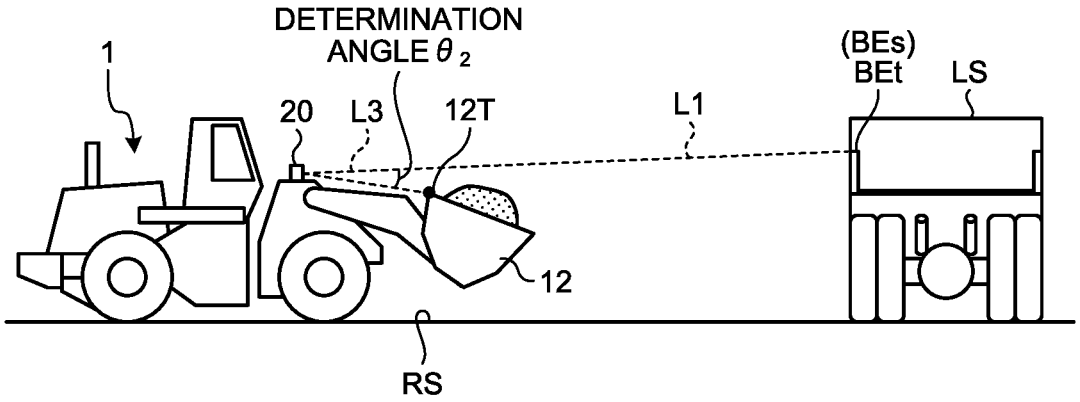
FIG. 11 is a diagram for describing a method for determining the specified condition according to the present embodiment.

FIG. 8 is a flowchart illustrating a method for controlling the wheel loader 1 according to the present embodiment, the flowchart including a method for determining a specified condition. FIGS. 9, 10, and 11 are diagrams for describing a method for determining the specified condition.

In the loading work mode in which the wheel loader 1 moves forward toward the transportation vehicle LS to load the excavation object excavated by the working equipment 10, the three-dimensional measurement device 20 measures a measurement target that includes at least the transportation vehicle LS. The measurement data in the three-dimensional measurement device 20 is output to the control device 80. The measurement data acquisition unit 81 acquires the measurement data from the three-dimensional measurement device 20 (Step S10).

The target calculation unit 86 calculates a distance Db between the tip portion 12B of the bucket 12 and the transportation vehicle LS on the basis of the measurement data acquired by the measurement data acquisition unit 81 and the position data of the bucket (Step S20). The position of the tip portion 12B of the bucket 12, which is the position data of the bucket, can be obtained by using working equipment data of the bucket 12 and angle data of the working equipment 10. The angle data of the working equipment 10 is detected by the angle sensor 50. The angle of the working equipment 10 includes an angle of the boom 11 detected by the boom angle sensor 51 and an angle of the bucket 12 detected by the bucket angle sensor 52. Angle data that indicates the angle of the working equipment 10 is output to the bucket calculation unit 83.

The bucket calculation unit 83 calculates a position of the lower end portion 12E of the bucket 12 on the basis of the angle data of the working equipment 10 and the working equipment data of the working equipment 10, the working equipment data being stored in the storage unit 82. The position of the lower end portion 12E of the bucket 12 is specified, for example, in the vehicle body coordinate system of the wheel loader 1 (Step S30). The position of the lower end portion 12E of the bucket 12 is not a predetermined position, but is identified from a position of a lower end portion of the outer shape of the bucket viewed from the three-dimensional measurement device 20.

For example, as illustrated in FIG. 9, in a case where the lower end portion 12E of the bucket 12 is placed below the upper end portion BEt of the vessel BE, as described with reference to FIG. 5, the upper end portion BEt of the vessel BE is hidden by the bucket 12, and the upper end portion BEt of the vessel BE is not placed within the measurement range AR of the three-dimensional measurement device 20. In this state, although an upper end portion BEs of the vessel BE in the measurement data in FIG. 9 is determined to be the upper end portion of the vessel BE, this determination is incorrect, because a position of the upper end portion BEs of the vessel BE in the measurement data does not match the position of the upper end portion BEt of an actual vessel BE, as illustrated in FIG. 9. Therefore, in cases of states illustrated in FIGS. 5 and 9, the working equipment control unit 87 determines that the position of the upper end portion BEt of the vessel BE cannot be calculated.

The overlap determination unit 84 determines whether or not the upper end portion BEt of the actual vessel BE and the bucket 12 overlap each other. In a case where it is determined that the both do not overlap each other, the position of the upper end portion BEs of the vessel BE in the measurement data matches the position of the upper end portion BEt of the actual vessel BE as illustrated in FIG. 10, and therefore, it can be determined that height of the upper end portion BEs of the vessel BE in the measurement data is height of the upper end portion BEt of the actual vessel BE.

For example, as illustrated in FIG. 10, in a case where a determination angle θ1 formed by a virtual line L1 connecting the three-dimensional measurement device 20 and the upper end portion BEs of the vessel BE in the measurement data, and a virtual line L2 connecting the three-dimensional measurement device 20 and the lower end portion 12E of the bucket BE is equal to or larger than a predetermined angle, as described with reference to FIG. 6, the upper end portion BEt of the vessel BE appears, and the upper end portion BEt of the vessel BE is placed within the measurement range AR of the three-dimensional measurement device 20. In cases of states illustrated in FIGS. 6 and 10, the overlap determination unit 84 can determine that the bucket 12 and the transportation vehicle LS do not overlap each other. Meanwhile, as illustrated in FIG. 9, in a case where the determination angle θ1 is approximately 0 degrees, it is highly possible that an actual upper end portion BEt overlaps the bucket 12. In this case, the overlap determination unit 84 determines that the actual upper end portion BEt cannot be calculated.

The target calculation unit 86 calculates the position of the upper end portion BEs in the measurement data on the basis of the measurement data acquired by the measurement data acquisition unit 81. The position of the upper end portion BEs of the vessel BE is specified, for example, in the vehicle body coordinate system of the wheel loader 1 (Step S60).

The working equipment control unit 87 calculates the determination angle θ1 on the basis of the calculated position of the lower end portion 12E of the bucket 12, the calculated position of the upper end portion BEs of the vessel BE in the measurement data, and the position of the three-dimensional measurement device 20 in the vehicle body coordinate system (Step S70). The position of the three-dimensional measurement device 20 in the vehicle body coordinate system is known and stored in the storage unit 82. Furthermore, the position of the lower end portion 12E of the bucket 12 and the position of the upper end portion BEs of the vessel BE in the measurement data are specified in the vehicle body coordinate system. Therefore, the working equipment control unit 87 can calculate the determination angle θ1.

The working equipment control unit 87 determines whether or not a determination angle θ is equal to or larger than a predetermined threshold (Step S80). The threshold is an angle larger than 0 [°]. In the present embodiment, the threshold is 5 [°], for example. This is because it is not possible to determine whether or not the upper end portion BEs of the vessel BE in the measurement data is the upper end portion BEt of the actual vessel BE, unless the virtual line L1 and the virtual line L2 are separated from each other to some extent.

In Step S80, in a case where it is determined that the determination angle θ1 is not equal to or larger than the threshold (Step S80: No), the working equipment control unit 87 controls motion of the working equipment 10 on the basis of the distance Db from the wheel loader 1 to the transportation vehicle LS (Step S50).

In Step S80, in a case where it is determined that the determination angle θ is equal to or larger than the threshold (Step S80: Yes), the target calculation unit 86 calculates height Hb of the upper end portion BEt of the vessel BE from the ground RS on the basis of the position of the upper end portion of the vessel BE (Step S85).

The working equipment control unit 87 controls motion of the working equipment 10 on the basis of the height Hb of the upper end portion of the vessel BE and the distance Db from the wheel loader 1 to the transportation vehicle LS (Step S90).

That is, as described with reference to FIG. 3, in a state where the wheel loader 1 is moving forward to approach the transportation vehicle LS, and on the basis of the height of the upper end portion of the vessel BE and the distance to the transportation vehicle LS, which are calculated by the target calculation unit 86, the working equipment control unit 87 causes the boom 11 to perform rising motion by controlling an angle of the bucket 12 so that the bucket 12 is placed above the upper end portion of the vessel BE and that the excavation object held by the bucket 12 does not spill out of the bucket 12. After the boom 11 performs rising motion and the bucket 12 is placed above the vessel BE, the working equipment control unit 87 controls the working equipment 10 so that the bucket 12 performs tilting motion. With this arrangement, the excavation object is discharged from the bucket 12 and loaded to the vessel BE.

Furthermore, the travel speed of the wheel loader 1 and height of the bucket at a moment may be taken into consideration. With this arrangement, it is possible to control the working equipment 10 at optimal rising speed so that the position of the tip portion 12B is higher than the upper end portion BEt of the vessel BE immediately before the tip portion 12B reaches the closest point of the transportation vehicle LS.

In the present embodiment, even if the upper end portion of the vessel BE appears within the measurement range AR, the working equipment control unit 87 controls the working equipment 10 without reference to the height of the upper end portion of the vessel BE but only on the basis of the distance to the vessel BE, until the determination angle θ1 is determined to be equal to or larger than the threshold.

It should be noted that, in the present embodiment, it is determined whether or not a specified condition is satisfied on the basis of the determination angle θ1. In a case where the bucket 12 is located below as illustrated in FIG. 11, it may be determined that the upper end portion BEt of the actual bucket BE can be calculated if a determination angle θ2 formed by a virtual line L1 connecting the three-dimensional measurement device 20 and the upper end portion BEt of the vessel BE, and a virtual line L2 connecting the three-dimensional measurement device 20 and the upper end portion 12T of the bucket 12 is equal to or larger than a predetermined angle (a direction opposite to θ1). Furthermore, in a case where the bucket 12 is located below, if even a small portion of the vessel BE is detected, the position of the upper end portion BEs of the vessel BE in the measurement data matches the position of the upper end portion BEt of the actual vessel BE as illustrated in FIG. 11, and therefore, it can be determined that the upper end portion BEt of the actual bucket BE can be calculated.

The overlap determination unit 84 may determine there is overlap not only in a case where an entire region of the upper end portion BEs of the vessel BE in the measurement data overlaps the bucket, but also in a case where, for example, a predetermined proportion of a region of the upper end portion BEs of the vessel BE in the measurement data overlaps the bucket.

It should be noted that whether or not the specified condition is satisfied may be determined on the basis of height He of the lower end portion 12E of the bucket 12 from the ground RS, the height He being based on the ground RS. For example, height of the upper end portion BEs of the vessel BE in the measurement data may be obtained in a case where the height He of the lower end portion 12E of the bucket 12 is higher by a predetermined distance than the upper end portion BEs of the vessel BE in the measurement data. The ground RS may be specified on the basis of a ground contact surface of the tires 6, for example. A position of the ground contact surface of the tires 6 is known data specified in the vehicle body coordinate system, for example.

It should be noted that, in a case where the wheel loader 1 is provided with an inertial measurement unit (Inertial Measurement Unit: IMU) or a tilt sensor, a position of the ground RS may be identified on the basis of detection data of the inertial measurement device or tilt sensor.

[Method for Calculating Position of Upper End Portion of Vessel Based on Measurement Data of Stereo Camera]

Next, a method for calculating the position of the upper end portion BEs of the vessel BE in measurement data of the stereo camera 22 will be described.

In the loading work mode in which the wheel loader 1 moves forward toward the transportation vehicle LS to load the excavation object excavated by the working equipment 10, the stereo camera 22 measures the transportation vehicle LS. The measurement data acquisition unit 81 acquires, from the stereo camera 22, the measurement data of the transportation vehicle LS measured by the stereo camera 22.

The stereo camera 22 measures distances to each of a plurality of measurement points PI on a surface of the transportation vehicle LS.

Figure 12:
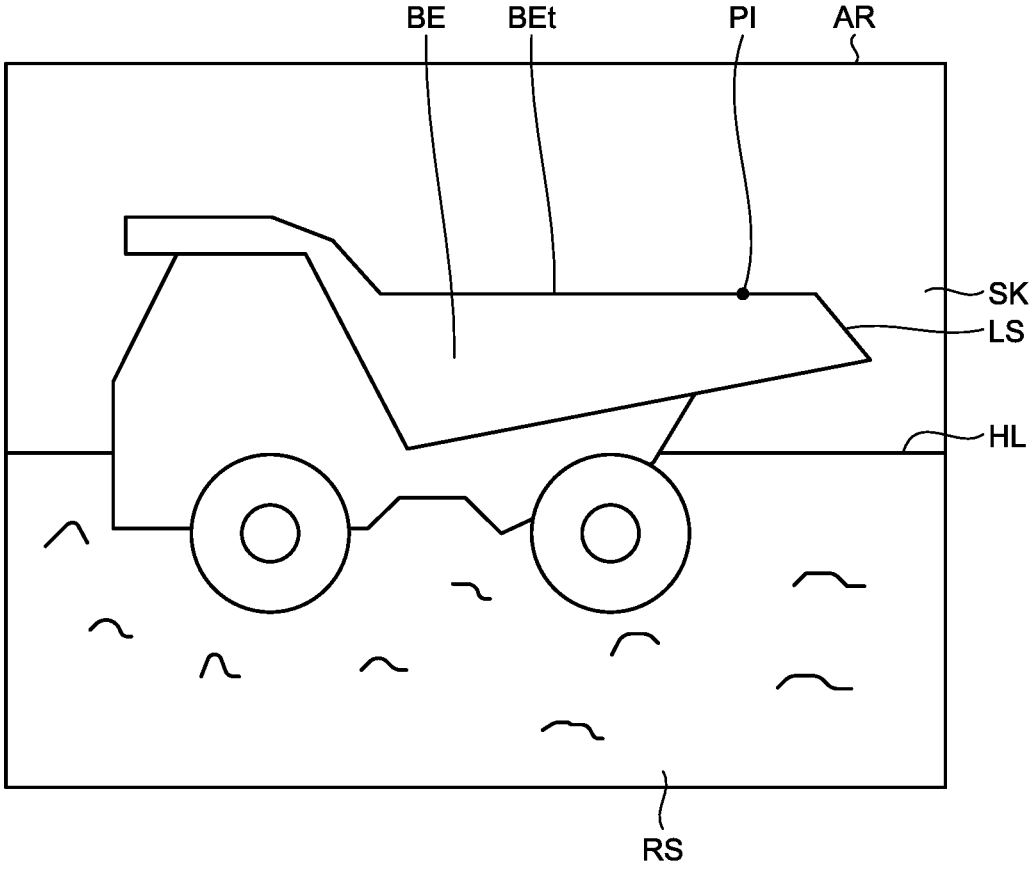
FIG. 12 is a diagram illustrating an example of image data including a transportation vehicle acquired by a stereo camera, according to the present embodiment.

FIG. 12 is a diagram illustrating an example of image data including the transportation vehicle LS acquired by the stereo camera 22 according to the present embodiment. In FIG. 12, an image illustrating the bucket 12 is omitted. It should be noted that, although only one measurement point PI (point data) is illustrated in FIG. 12, a measurement point PI is set for each pixel of the image data illustrated in FIG. 12. The stereo camera 22 can obtain point cloud data, namely three-dimensional data, which corresponds to each pixel by performing stereo processing on the image data.

On the basis of image data that is the measurement data of the stereo camera 22, the target calculation unit 86 calculates distances from the stereo camera 22 in the vehicle body coordinate system to the plurality of measurement points PI on the surface of the transportation vehicle LS that are viewed in each pixel. The target calculation unit 86 calculates a three-dimensional shape of the transportation vehicle LS on the basis of the distances to each of the plurality of measurement points PI on the surface of the transportation vehicle LS.

Next, the target calculation unit 86 creates a histogram illustrating a relation between distances from the stereo camera 22 and the number of data of measurement points PI that indicates the distances.

Figure 13:
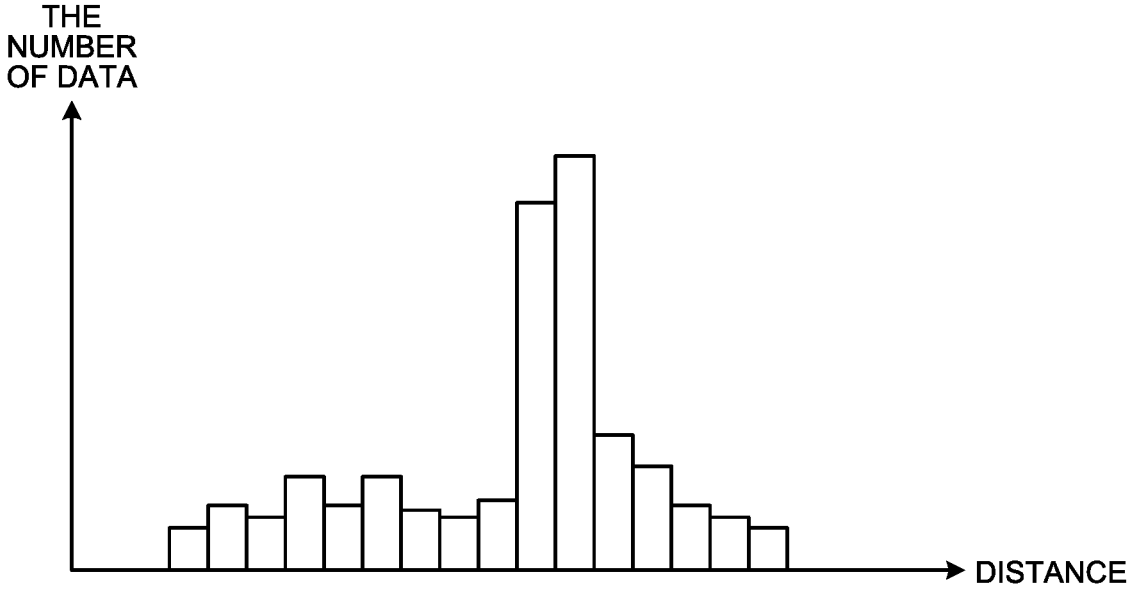
FIG. 13 is a schematic diagram illustrating a histogram that indicates a relation with the number of data of measurement points existing for each of distances from the stereo camera to the measurement points, according to the present embodiment.

FIG. 13 is a schematic diagram illustrating a histogram that indicates a relation between distances from the stereo camera 22 to the measurement points PI, and the number of data of the measurement points PI existing for each distance. Each distance has a constant distance width.

Because the image data illustrated in FIG. 12 includes a measurement target other than the transportation vehicle LS, such as ground for example, histogram data exists over a wide range of distances, as illustrated in FIG. 13. Meanwhile, a side surface region of the transportation vehicle LS occupies a large proportion of the image data illustrated in FIG. 12. Furthermore, a side surface of the transportation vehicle LS stands substantially vertically from ground, and distances from the stereo camera 22 to each of measurement points on the side surface of the transportation vehicle LS are substantially constant. Therefore, in the histogram, a large amount of data is counted for the distances from the stereo camera 22 to the measurement points PI of the transportation vehicle LS. The target calculation unit 86 determines that three-dimensional data within a distance width for which the large amount of data is counted to be measurement data of the transportation vehicle LS. Then, the target calculation unit 86 calculates the distance Db from the wheel loader 1 to the transportation vehicle LS on the basis of the three-dimensional data determined to be the measurement data of the transportation vehicle LS and the position data of the bucket 12. Furthermore, the target calculation unit 86 calculates height of the upper end portion BEs of the vessel BE in the measurement data on the basis of the three-dimensional data determined to be the measurement data of the transportation vehicle LS.

The working equipment control unit 87 controls the working equipment 10 on the basis of the height Hb of the upper end portion of the vessel BE and the distance Db to the transportation vehicle LS that are calculated by the target calculation unit 86.

[Method for Calculating Position of Upper End Portion of Vessel Based on Measurement Data of Laser Radar]

Next, a method for calculating a position of an upper end portion of the vessel BE based on measurement data of the laser radar 21 will be described.

Figure 14:
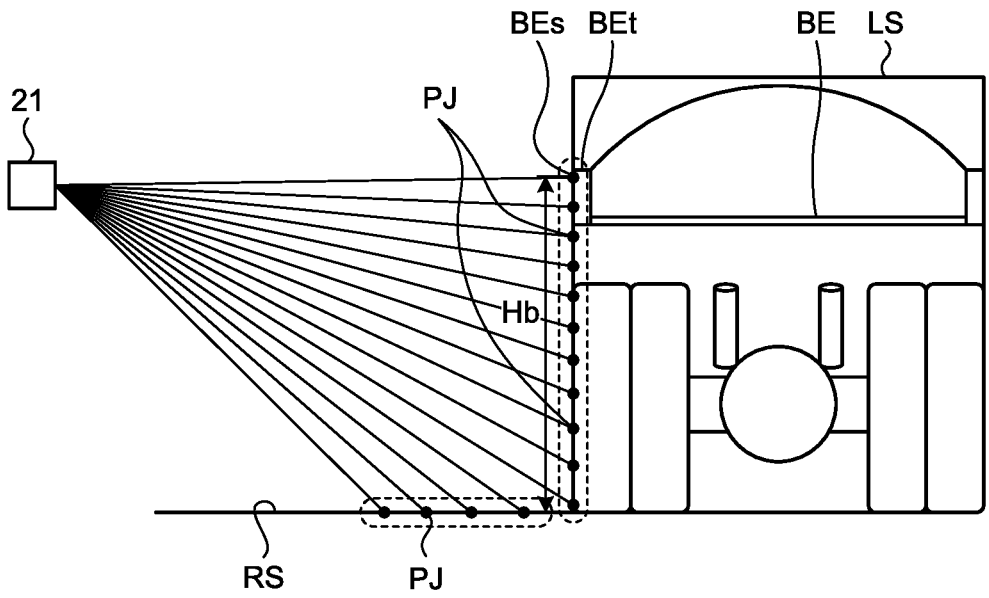
FIG. 14 is a diagram illustrating a measuring method by a laser radar.

FIG. 14 schematically illustrates a measuring method by the laser radar 21. It should be noted that, in FIG. 14, a diagram illustrating the bucket 12 is omitted. As illustrated in FIG. 14, the laser radar 21 measures distances to each of a plurality of irradiation points PJ on the surface of the transportation vehicle LS. The measurement data acquisition unit 81 acquires three-dimensional data including position data of each of the irradiation points PJ. The target calculation unit 86 divides the measured three-dimensional data into a ground group and a transportation vehicle group.

The target calculation unit 86 calculates the distance Db from the wheel loader 1 to the transportation vehicle LS, from three-dimensional data in the transportation vehicle group and position data of the working equipment 10.

The target calculation unit 86 extracts an irradiation point PJ existing at a highest position among the three-dimensional data in the transportation vehicle group, and calculates the height Hb of the upper end portion BEt of the vessel BE on the basis of this irradiation point PJ.

[Effects]

As described above, according to the present embodiment, when relative positions of the upper end portion of the vessel BE and the lower end portion of the bucket 12 satisfy a specified condition, the working equipment control unit 87 controls the working equipment 10 on the basis of a position of the upper end portion of the vessel BE and a distance from the wheel loader 1 to the transportation vehicle LS. In a state where the upper end portion of the vessel BE is hidden by the bucket 12, it is highly possible that a position of the upper end portion BEs of the vessel BE in the measurement data calculated by the target calculation unit 86 does not match a position of the upper end portion BEt of the actual vessel BE. In the present embodiment, when the upper end portion of the vessel BE is not blocked by the bucket 12 and satisfies a specified condition of being placed within the measurement range AR of the three-dimensional measurement device 20, the working equipment control unit 87 controls the working equipment 10 on the basis of the position of the upper end portion of the vessel BE calculated by the target calculation unit 86. With this arrangement, the working equipment control unit 87 can control the working equipment 10 on the basis of the position of the upper end portion of the vessel BE that is accurately calculated. Furthermore, when the specified condition is not satisfied, the working equipment control unit 87 controls the working equipment 10 without reference to the position of the upper end portion of the vessel BE. With this arrangement, the working equipment control unit 87 can prevent controlling the working equipment 10 on the basis of incorrect measurement data.

[Computer System]

Figure 15:
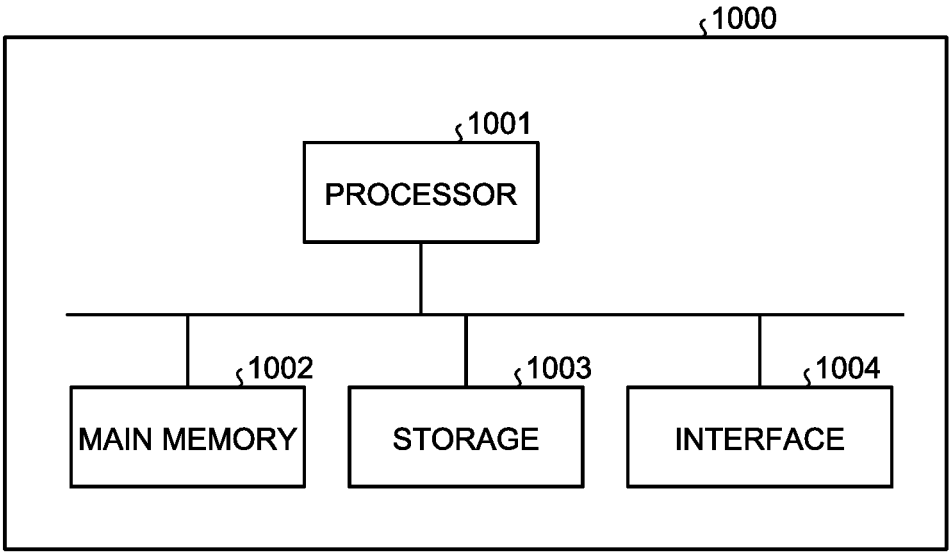
FIG. 15 is a block diagram illustrating an example of a computer system according to the present embodiment.

FIG. 15 is a block diagram illustrating an example of a computer system 1000. The above-described control device 80 includes the computer system 1000. The computer system 1000 has a processor 1001 such as a central processing unit (CPU), a main memory 1002 including a non-volatile memory such as a read only memory (RAM) and a volatile memory such as a random access memory (RAM), a storage 1003, and an interface 1004 including an input/output circuit. A function of the above-described control device 80 is stored in the storage 1003 as a program. The processor 1001 reads the program from the storage 1003, expands the program to the main memory 1002, and executes the above-described processing according to the program. It should be noted that the program may be delivered to the computer system 1000 via a network.

Other Embodiments

It should be noted that, in the above-described embodiment, the wheel loader 1 is provided with both the laser radar 21 and the stereo camera 22 as the three-dimensional measurement device 20. One of the laser radar 21 or the stereo camera 22 may be provided in the wheel loader 1. Furthermore, the three-dimensional measurement device 20 is required at least to measure a three-dimensional shape of a work target and relative positions with the work target, and is not limited to the laser radar 21 and the stereo camera 22.

In the above-described embodiment, instead of the three-dimensional measurement device 20, an image of the measurement target may be acquired by using an imaging device as a measurement device, and whether or not a bucket 12 overlaps an upper end portion of a vessel BE may be determined with image recognition by artificial intelligence (Artificial Intelligence: AI), or the like. Furthermore, presence of overlap of the bucket 12 and the upper end portion of the vessel BE may be determined by an analysis by AI, or the like, on the basis of three-dimensional data measured by the three-dimensional measurement device 20.

In the above-described embodiment, whether or not an upper end portion BEs of the vessel BE in measurement data is hidden by the bucket 12 is determined. However, not limited to the form, for example, whether or not an entire transportation vehicle LS in the measurement data is hidden by the bucket 12 may be determined. Then, for example, the working equipment control unit 87 may not control the working equipment 10 in a case where a region larger than a predetermined proportion with respect to a region of the entire transportation vehicle LS in the measurement data overlaps the bucket 12, and the working equipment control unit 87 may control the working equipment 10 on the basis of a position of a measured loading target when it is determined that only a region of equal to or less than the predetermined proportion with respect to the region of the entire transportation vehicle LS overlaps the bucket.

In the above-described embodiment, the working equipment 10 is controlled on the basis of distance Db to the transportation vehicle LS in a case where it is determined that the upper end portion BEs of the vessel BE in the measurement data is hidden by the bucket 12. However, not limited to the form, the working equipment 10 may not be controlled, or the working equipment 10 may be controlled to rise at predetermined rising speed, in a case where, for example, it is determined that the upper end portion BEs of the vessel BE in the measurement data is hidden by the bucket 12.

Alternatively, a target calculation unit 86 may store in a storage unit 82 height Hb of an upper end portion BEt of the vessel BE measured in a state as illustrated in FIG. 11, and may control the working equipment 10 on the basis of the stored height Hb of the upper end portion BEt of the vessel BE even in a case where it is determined that the upper end portion BEt of the vessel BE is hidden by the bucket 12 in a state as illustrated in FIG. 9.

It should be noted that, in each of the above-described embodiments, the work site where the wheel loader 1 performs work may be a mining site of a mine, or may be a construction site or a building site.

It should be noted that the wheel loader 1 may be used for snow removal work, may be used for work in agriculture or livestock farming, or may be used for work in forestry.

It should be noted that, in the above-described embodiments, the bucket 12 may have a plurality of blades or may have a straight cutting edge.

It should be noted that a work member coupled to a tip portion of a boom 11 may not necessarily be the bucket 12 but may be a snow plow or snow bucket used for snow removal work, a bale glove or fork used for work in agriculture or livestock farming, or a fork or bucket used for work in forestry.

It should be noted that a loading machine (working machine) is not limited to a wheel loader, but the control device 80 and control method described in the above-described embodiments can be applied to a loading machine having working equipment such as an excavator or a bulldozer, for example.

REFERENCE SIGNS LIST

1 WHEEL LOADER (LOADING MACHINE)
2 VEHICLE BODY
2F VEHICLE BODY FRONT PART
2R VEHICLE BODY REAR PART
3 CAB
4 TRAVEL DEVICE
4A DRIVE DEVICE
4B BRAKE DEVICE
4C STEERING DEVICE
5 WHEELS
5F FRONT WHEELS
5R REAR WHEELS
6 TIRES
6F FRONT TIRES
6R REAR TIRES
9 JOINT MECHANISM
10 WORKING EQUIPMENT
11 BOOM
12 BUCKET
12B TIP PORTION
12E LOWER END PORTION
13 BOOM CYLINDER
14 BUCKET CYLINDER
15 BELL CRANK
16 LINK
20 THREE-DIMENSIONAL MEASUREMENT DEVICE
21 LASER RADAR
22 STEREO CAMERA
22A FIRST CAMERA
22B SECOND CAMERA
30 TRANSMISSION DEVICE
40 TRAVEL OPERATION DEVICE
50 ANGLE SENSOR
51 BOOM ANGLE SENSOR
52 BUCKET ANGLE SENSOR
80 CONTROL DEVICE
80 MEASUREMENT DATA ACQUISITION UNIT
82 STORAGE UNIT
83 BUCKET CALCULATION UNIT
86 TARGET CALCULATION UNIT
87 WORKING EQUIPMENT CONTROL UNIT
88 TRANSMISSION CONTROL UNIT
89 TRAVEL CONTROL UNIT
AR MEASUREMENT RANGE
BE VESSEL (LOADING TARGET)
DS ROCK MASS (EXCAVATION TARGET)
FX ROTATION SHAFT
LS TRANSPORTATION VEHICLE
PJ IRRADIATION POINT
RX ROTATION SHAFT
RS Ground

The invention claimed is:

1. A loading machine control device comprising:

a measurement data acquisition processor unit that acquires measurement data of a measurement device mounted in a loading machine that has working equipment;

a target calculation processor unit that calculates, on the basis of the measurement data, a position of an upper end portion of a loading target to which an excavation object excavated by a bucket of the working equipment is loaded;

a bucket calculation processor unit that calculates position data of the bucket;

an overlap determination processor unit that determines whether or not the upper end portion of the loading target and the bucket that are in the measurement data overlap each other; and a working equipment control processor unit that controls the working equipment on the basis of the measured position of the upper end portion of the loading target when it is determined that the upper end portion of the loading target and the bucket that are in the measurement data do not overlap each other, wherein the overlap determination processor unit determines whether or not there is overlap on the basis of relative positions of the measurement device, the upper end portion of the loading target, and the bucket, wherein the bucket calculation processor unit calculates a position of a lower end portion of the bucket, and the target calculation processor unit calculates the position of the upper end portion of the loading target when an angle specified on the basis of the measurement device, the upper end portion of the loading target, and the lower end portion of the bucket is equal to or larger than a predetermined angle.

2. The loading machine control device according to claim 1, wherein the target calculation processor unit calculates a distance from the loading machine to the loading target on the basis of the measurement data and the position data of the bucket, and the working equipment control processor unit controls the working equipment on the basis of the position of the upper end portion of the loading target and the distance in a case where it is determined that the upper end portion of the loading target and the bucket that are in the measurement data do not overlap each other, and controls the working equipment on the basis of the distance in a case where it is determined that the upper end portion of the loading target and the bucket that are in the measurement data overlap each other.

3. The loading machine control device according to claim 1, wherein the measurement device includes an imaging device, the measurement data includes image data, and the overlap determination processor unit determines whether or not the upper end portion of the loading target and the bucket that are in the measurement data overlap each other, on the basis of an image analysis based on the image data.

4. The loading machine control device according to claim 1, wherein the target calculation processor unit stores the position of the upper end portion of the loading target in a case where it is determined that the upper end portion of the loading target and the bucket that are in the measurement data do not overlap each other, and the working equipment control processor unit controls the working equipment on the basis of the stored position of the upper end portion of the loading target in a case where it is determined that the upper end portion of the loading target and the bucket that are in the measurement data overlap each other.

5. A loading machine control device comprising:

a measurement data acquisition processor unit that acquires measurement data of a measurement device mounted in a loading machine that has working equipment;

a target calculation processor unit that calculates, on the basis of the measurement data, a position of a loading target to which an excavation object excavated by a bucket of the working equipment is loaded;

a bucket calculation processor unit that calculates position data of the bucket;

an overlap determination processor unit that determines whether or not the loading target and the bucket overlap each other in the measurement data; and a working equipment control processor unit that does not control the working equipment when it is determined that a portion of the loading target, the portion being larger than a predetermined proportion, overlaps the bucket, and that controls the working equipment on the basis of the measured position of the loading target when it is determined that only a portion of the loading target, the portion being smaller than the predetermined proportion, overlaps the bucket, wherein the overlap determination processor unit determines whether or not there is overlap on the basis of relative positions of the measurement device, the upper end portion of the loading target, and the bucket, wherein the bucket calculation processor unit calculates a position of a lower end portion of the bucket, and the target calculation processor unit calculates the position of the upper end portion of the loading target when an angle specified on the basis of the measurement device, the upper end portion of the loading target, and the lower end portion of the bucket is equal to or larger than a predetermined angle.

6. A loading machine control method comprising:

acquiring measurement data of a measurement device mounted in a loading machine that has working equipment;

calculating, on the basis of the measurement data, a position of an upper end portion of a loading target to which an excavation object excavated by a bucket of the working equipment is loaded;

calculating position data of the bucket;

determining whether or not the upper end portion of the loading target and the bucket that are in the measurement data overlap each other; and controlling the working equipment on the basis of the measured position of the upper end portion of the loading target when it is determined that the upper end portion of the loading target and the bucket that are in the measurement data do not overlap each other, wherein the overlap is determined on the basis of relative positions of the measurement device, the upper end portion of the loading target, and the bucket, wherein position data of the bucket is a position of a lower end portion of the bucket, and wherein the position of the upper end portion of the loading target is calculated when an angle specified on the basis of the measurement device, the upper end portion of the loading target, and the lower end portion of the bucket is equal to or larger than a predetermined angle.

7. A computer system comprising:

a measurement data acquisition processor unit that acquires measurement data of a measurement device mounted in a loading machine that has working equipment;

a target calculation processor unit that calculates, on the basis of the measurement data, a position of an upper end portion of a loading target to which an excavation object excavated by a bucket of the working equipment is loaded;

a bucket calculation processor unit that calculates position data of the bucket;

an overlap determination processor unit that determines whether or not the upper end portion of the loading target and the bucket that are in the measurement data overlap each other; and a working equipment control processor unit that controls the working equipment on the basis of the measured position of the upper end portion of the loading target when it is determined that the upper end portion of the loading target and the bucket that are in the measurement data do not overlap each other, wherein the overlap determination processor unit determines whether or not there is overlap on the basis of relative positions of the measurement device, the upper end portion of the loading target, and the bucket, wherein the bucket calculation processor unit calculates a position of a lower end portion of the bucket, and the target calculation processor unit calculates the position of the upper end portion of the loading target when an angle specified on the basis of the measurement device, the upper end portion of the loading target, and the lower end portion of the bucket is equal to or larger than a predetermined angle.

* * * * *